US007938231B2

(12) United States Patent
Ueda et al.

(10) Patent No.: US 7,938,231 B2
(45) Date of Patent: May 10, 2011

(54) ELEVATOR APPARATUS HAVING INDEPENDENT SECOND BRAKE CONTROL

(75) Inventors: Takaharu Ueda, Tokyo (JP); Rikio Kondo, Tokyo (JP); Hiroshi Kigawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 559 days.

(21) Appl. No.: 12/064,394

(22) PCT Filed: Jul. 27, 2006

(86) PCT No.: PCT/JP2006/314888

§ 371 (c)(1),
(2), (4) Date: Feb. 21, 2008

(87) PCT Pub. No.: WO2008/012896

PCT Pub. Date: Jan. 31, 2008

(65) Prior Publication Data

US 2009/0255764 A1 Oct. 15, 2009

(51) Int. Cl.
*B66B 1/32* (2006.01)

(52) U.S. Cl. ..... 187/288; 187/393

(58) Field of Classification Search ..... 187/247, 187/277, 287, 288, 291–293, 296, 297, 391–393
See application file for complete search history.

(56) References Cited

U.S. PATENT DOCUMENTS

| | | | | |
|---|---|---|---|---|
| 6,173,814 | B1 * | 1/2001 | Herkel et al. | 187/288 |
| 7,669,697 | B2 * | 3/2010 | Ueda et al. | 187/391 |
| 7,730,998 | B2 * | 6/2010 | Takahashi et al. | 187/288 |
| 7,735,610 | B2 * | 6/2010 | Huard et al. | 187/288 |
| 2007/0284196 | A1 | 12/2007 | Sakai et al. | |
| 2009/0229924 | A1 * | 9/2009 | Kondo et al. | 187/288 |
| 2009/0255764 | A1 * | 10/2009 | Ueda et al. | 187/288 |
| 2009/0266649 | A1 * | 10/2009 | Kondo et al. | 187/288 |
| 2010/0032245 | A1 * | 2/2010 | Shibata et al. | 187/288 |
| 2010/0101896 | A1 * | 4/2010 | Ueda et al. | 187/254 |
| 2010/0155183 | A1 * | 6/2010 | Takahashi et al. | 187/288 |

FOREIGN PATENT DOCUMENTS

| | | |
|---|---|---|
| JP | 7 157211 | 6/1995 |
| JP | 7 242377 | 9/1995 |
| JP | 2004 231355 | 8/2004 |
| JP | 2006 8333 | 1/2006 |

OTHER PUBLICATIONS

U.S. Appl. No. 12/740,371, filed Apr. 29, 2010, Kondo, et al.
U.S. Appl. No. 12/532,414, filed Sep. 22, 2009, Ueda, et al.
U.S. Appl. No. 11/791,850, filed May 30, 2007, Ueda, et al.
U.S. Appl. No. 11/791,470, filed May 24, 2007, Takahashi, et al.
U.S. Appl. No. 11/794,198, filed Jun. 26, 2007, Okamoto, et al.
U.S. Appl. No. 11/814,039, filed Jul. 16, 2007, Okamoto, et al.
U.S. Appl. No. 11/794,321, filed Jun. 28, 2007, Shibata, et al.
U.S. Appl. No. 11/794,823, filed Jul. 6, 2007, Ueda, et al.
U.S. Appl. No. 11/908,851, filed Sep. 17, 2007, Kondo, et al.
U.S. Appl. No. 12/064,910, filed Feb. 26, 2008, Kondo, et al.

* cited by examiner

*Primary Examiner* — Jonathan Salata
(74) *Attorney, Agent, or Firm* — Oblon, Spivak, McClelland, Maier & Neustadt, L.L.P.

(57) ABSTRACT

In an elevator apparatus, a brake control device has a first brake control portion for operating a brake device upon detection of an abnormality to stop a car as an emergency measure, and a second brake control portion for reducing a braking force of the brake device when a degree of deceleration of the car becomes equal to or higher than a predetermined value at a time of emergency braking operation of the first brake control portion. The second brake control portion detects emergency braking operation of the brake device independently of the first brake control portion.

14 Claims, 7 Drawing Sheets

ELEVATOR APPARATUS HAVING INDEPENDENT SECOND BRAKE CONTROL

TECHNICAL FIELD

The present invention relates to an elevator apparatus having a brake control device capable of controlling a degree of deceleration of a car at a time of emergency braking.

BACKGROUND ART

In a conventional brake device for an elevator, the braking force of an electromagnetic brake is controlled at the time of emergency braking such that the degree of deceleration of a car becomes equal to a predetermined value, based on a deceleration command value and a speed signal (e.g., see Patent Document 1).

Patent Document 1: JP 07-157211 A

DISCLOSURE OF THE INVENTION

Problems to be Solved by the Invention

In the conventional brake device configured as described above, both a basic operation of emergency braking and an operation of controlling the braking force are performed by a single brake control unit. Therefore, when the degree of deceleration of the car becomes excessively high due to a malfunction in the brake control unit or the like, passengers feel uncomfortable. On the contrary, when the degree of deceleration of the car becomes excessively low due to a malfunction in the brake control unit or the like, the braking distance of the car becomes longer.

The present invention has been made to solve the above-mentioned problems, and it is therefore an object of the present invention to obtain an elevator apparatus that makes it possible to stop a car more positively even in the event of a malfunction in a deceleration control portion while suppressing the degree of deceleration of the car at the time of emergency braking.

Means for Solving the Problems

An elevator apparatus according to the present invention includes: a hoisting machine having a drive sheave, a motor for rotating the drive sheave, and a brake device for braking rotation of the drive sheave; suspension means looped around the drive sheave; a car suspended by the suspension means to be raised/lowered by the hoisting machine; and a brake control device for controlling the brake device, in which: the brake control device has a first brake control portion for operating the brake device upon detection of an abnormality to stop the car as an emergency measure, and a second brake control portion for reducing a braking force of the brake device when a degree of deceleration of the car becomes equal to or higher than a predetermined value at a time of emergency braking operation of the first brake control portion; and the second brake control portion detects emergency braking operation of the brake device independently of the first brake control portion.

BEST MODE FOR CARRYING OUT THE INVENTION

A preferred embodiment of the present invention will be described herein after with reference to the drawings.

Embodiment 1

Figure 1:
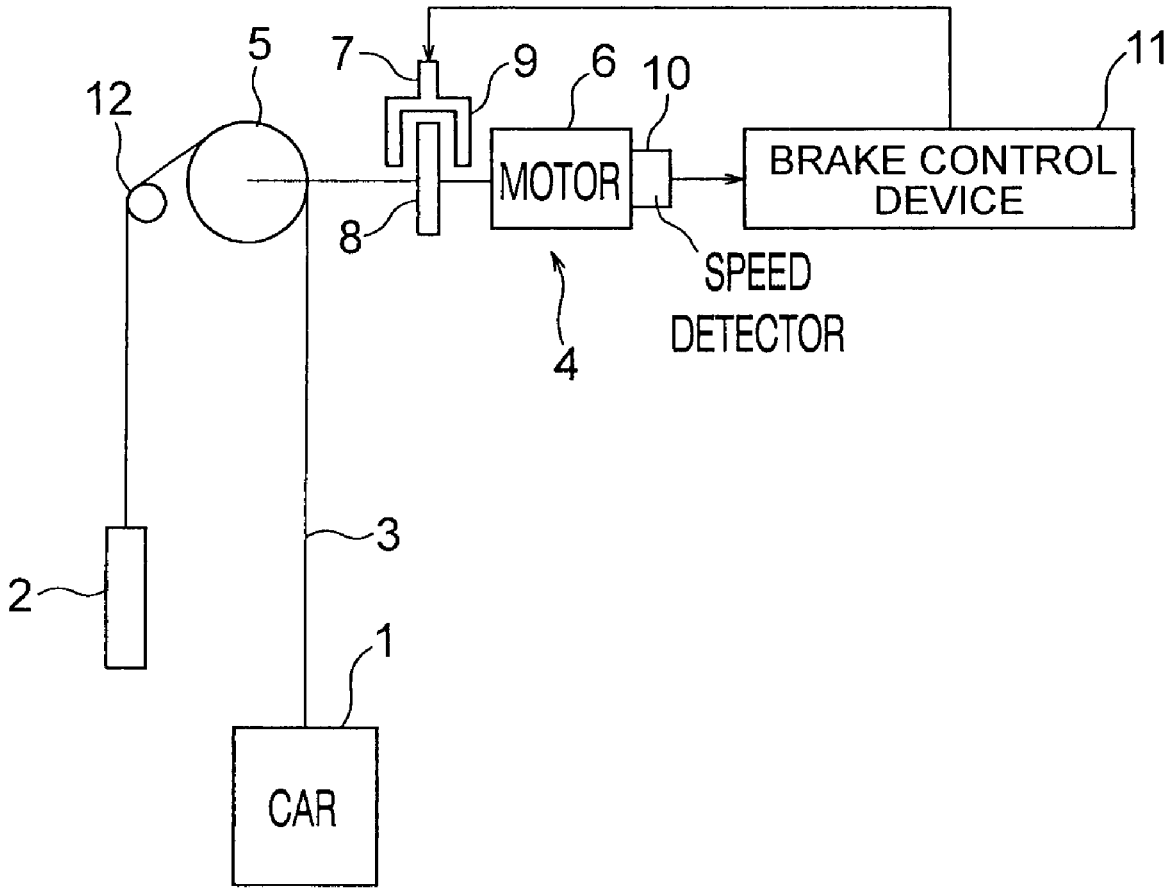
FIG. 1 is a schematic diagram showing an elevator apparatus according to Embodiment 1 of the present invention.

FIG. 1 is a schematic diagram showing an elevator apparatus according to Embodiment 1 of the present invention. A car 1 and a counterweight 2, which are suspended within a hoistway by a main rope (suspension means) 3, are raised/lowered within the hoistway due to a driving force of a hoisting machine 4. The hoisting machine 4 has a drive sheave 5 around which the main rope 3 is looped, a motor 6 for rotating the drive sheave 5, and braking means 7 for braking rotation of the drive sheave 5.

The braking means 7 has a brake pulley 8 that is rotated integrally with the drive sheave 5, and a brake device 9 for braking rotation of the brake pulley 8. The drive sheave 5, the motor 6, and the brake pulley 8 are provided coaxially. The brake device 9 has a brake shoe that is moved into contact with and away from the brake pulley 8, a brake spring for pressing the brake shoe against the brake pulley 8, and an electromagnet for opening the brake shoe away from the brake pulley 8 against the brake spring.

The motor 6 is provided with a speed detector 10 for generating a signal corresponding to a rotational speed of a rotary shaft of the motor 6, that is, a rotational speed of the drive sheave 5. Employed as the speed detector 10 is, for example, an encoder or a resolver.

A signal from the speed detector 10 is input to a brake control device 11. The brake control device 11 controls the brake device 9. A deflector pulley 12 is disposed in the vicinity of the drive sheave 5.

Figure 2:
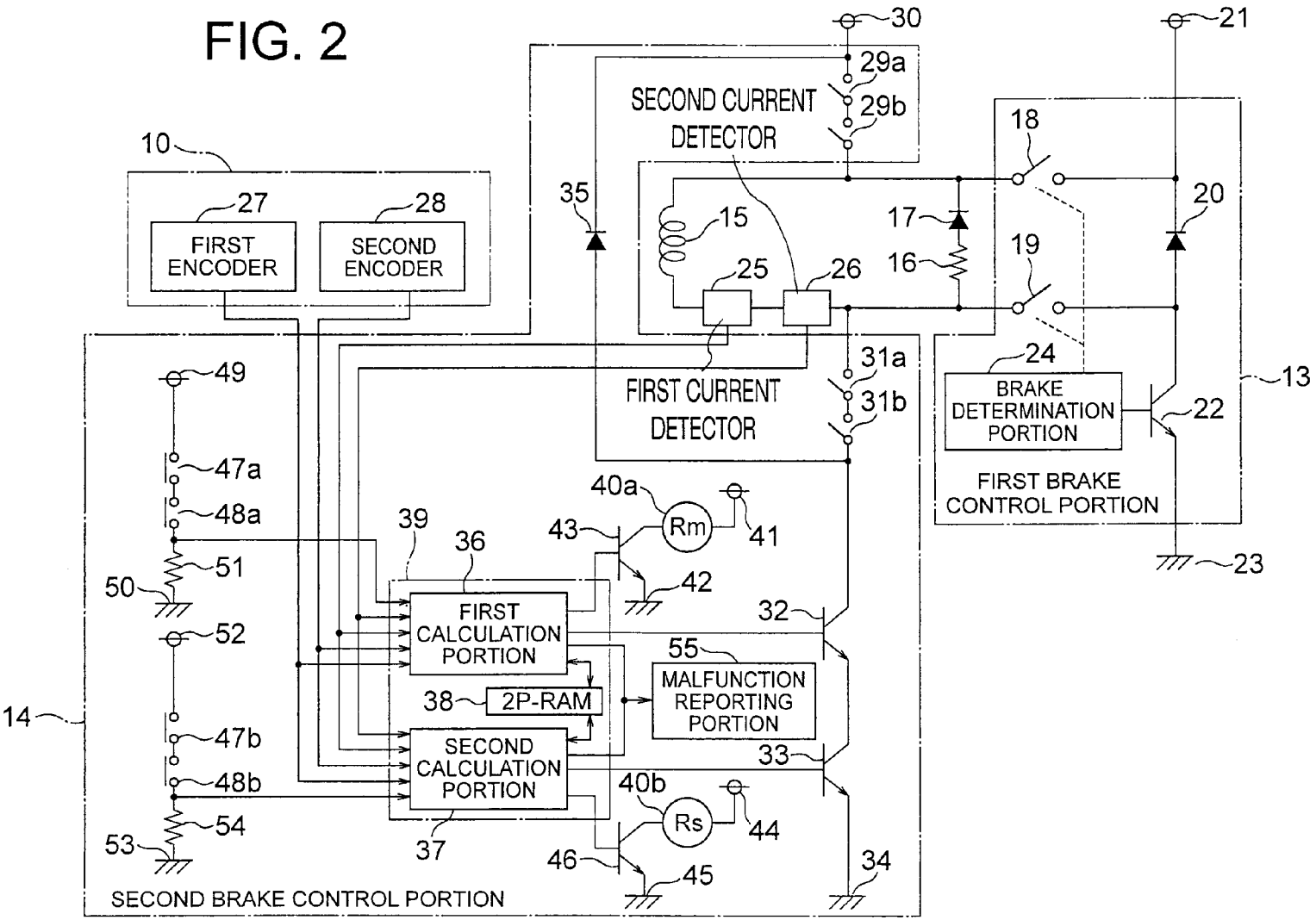
FIG. 2 is a circuit diagram showing a brake control device of FIG. 1 partially in the form of blocks.

FIG. 2 is a circuit diagram showing the brake control device 11 of FIG. 1 partially in the form of blocks. The brake control device 11 has a first brake control portion 13 and a second brake control portion 14 that control the brake device 9 independently of each other.

The electromagnet of the brake device 9 is provided with a brake coil (electromagnetic coil) 15. By causing a current to flow through the brake coil 15, the electromagnet is excited to generate an electromagnetic force for canceling a braking force of the brake device 9, so the brake shoe is opened away from the brake pulley 8. By shutting off the supply of a current to the brake coil 15, excitation of the electromagnet is canceled, so the brake shoe is pressed against the brake pulley 8 due to a spring force of the brake spring. In addition, by controlling a value of the current flowing through the brake coil 15, the degree of the opening of the brake device 9 can be controlled.

A circuit in which a discharge resistor 16 and a first discharge diode 17 are connected in series is connected in parallel to the brake coil 15. A second discharge diode 20 is connected in parallel to the brake coil 15 at both ends thereof via a first electromagnetic relay 18 and a second electromagnetic relay 19, respectively. Further, the brake coil 15 is connected on the first electromagnetic relay 18 side thereof to a power supply 21. Still further, the brake coil 15 is connected on the second electromagnetic relay 19 side thereof to a ground 23 of the power supply 21 via a brake switch 22. A semiconductor switch is employed as the brake switch 22.

The turning ON/OFF of the brake switch 22 is controlled by a brake determination portion 24. In raising/lowering the car 1, the brake determination portion 24 turns the brake switch 22 ON to energize the brake coil 15, thereby canceling the braking force of the brake device 9. In stopping the car 1, the brake determination portion 24 turns the brake switch 22 OFF to deenergize the brake coil 15, thereby causing the brake device 9 to generate a braking force (to hold car 1 stationary).

In addition, when some abnormality is detected in the elevator apparatus, the brake determination portion 24 turns the brake switch 22 OFF and opens the electromagnetic relays 18 and 19, thereby deenergizing the brake coil 15 and causing the brake device 9 to perform braking operation. Thus, the car 1 is stopped as an emergency measure. After the electromagnetic relays 18 and 19 are opened, the discharge resistor 16 and the first discharge diode 17 swiftly reduce the induction current flowing through the brake coil 15 to precipitate generation of a braking force.

The function of the brake determination portion 24 is realized by, for example, a first microcomputer (not shown) provided in an elevator control device for controlling the traveling of the car 1. That is, a program for realizing the function of the brake determination portion 24 is stored in the first microcomputer.

The first brake control portion (main control portion) 13 has the electromagnetic relays 18 and 19, the second discharge diode 20, the brake switch 22, and the brake determination portion 24. The first brake control portion 13 also includes a safety circuit (not shown) for opening the electromagnetic relays 18 and 19 in response to an abnormality in the elevator apparatus.

The current flowing through the brake coil 15 is detected by a first current detector 25 and a second current detector 26. The speed detector 10 is provided with a first encoder 27 and a second encoder 28, which are each designed as a speed sensor for generating a signal corresponding to a rotational speed of the motor 6.

An endpoint node between the brake coil 15 and the first electromagnetic relay 18 is connected to a power supply 30 via a circuit in which a third electromagnetic relay 29*a* and a fourth electromagnetic relay 29 bare connected in series. An end point node between the brake coil 15 and the second electromagnetic relay 19 is connected to a ground 34 of the power supply 30 via a circuit in which a fifth electromagnetic relay 31*a*, a sixth electromagnetic relay 31*b*, a first deceleration control switch 32, and a second deceleration control switch 33 are connected in series.

A third discharge diode 35 is connected in parallel to a circuit in which the third electromagnetic relay 29*a*, the fourth electromagnetic relay 29*b*, the brake coil 15, the fifth electromagnetic relay 31*a*, and the sixth electromagnetic relay 31*b* are connected in series.

The first deceleration control switch 32 and the second deceleration control switch 33 each serve to control the degree of deceleration of the car 1 at the time of emergency braking of the car 1. Semiconductor switches are employed as the deceleration control switches 32 and 33. The deceleration control performed by the first deceleration control switch 32 and the second deceleration control switch 33 is validated when all the electromagnetic relays 29*a*, 29*b*, 31*a*, and 31*b* are closed, and is invalidated when one of the electromagnetic relays 29*a*, 29*b*, 31*a*, and 31*b* is open.

The turning ON/OFF of the first deceleration control switch 32 is controlled by a first calculation portion 36. The turning ON/OFF of the second deceleration control switch 33 is controlled by a second calculation portion 37. The first calculation portion 36 is constituted by a second microcomputer. The second calculation portion 37 is constituted by a third microcomputer.

A two-port RAM 38 is connected between the first calculation portion 36 and the second calculation portion 37. A deceleration control determination portion 39 has the first calculation portion 36, the second calculation portion 37, and the two-port RAM 38.

Signals from the first current detector 25 and the second current detector 26 and signals from the first encoder 27 and the second encoder 28 are input to the first calculation portion 36. The signals from the first current detector 25 and the second current detector 26 and the signals from the first encoder 27 and the second encoder 28 are also input to the second calculation portion 37.

The first calculation portion 36 calculates a position y [m] of the car 1, a speed V [m/s] of the car 1, and a deceleration $\gamma$ [m/s$^2$] of the car 1 based on the signals from the first encoder 27 and the second encoder 28. The first calculation portion 36 controls the turning ON/OFF of the first deceleration control switch 32 based on the speed of the car 1, the degree of deceleration of the car 1, and the current value of the brake coil 15.

The second calculation portion 37 calculates a position y [m] of the car 1, a speed V [m/s] of the car 1, and a deceleration $\gamma$ [m/s$^2$] of the car 1 independently of the first calculation portion 36, based on the signals from the first encoder 27 and the second encoder 28. The second calculation portion 37 controls the turning ON/OFF of the second deceleration control switch 33 based on the speed of the car 1, the degree of deceleration of the car 1, and the current value of the brake coil 15.

The third electromagnetic relay 29*a* and the fifth electromagnetic relay 31*a* are opened/closed by a first drive coil 40*a*. The first drive coil 40*a* is connected to a power supply 41 and a ground 42. A first drive coil control switch 43 for turning ON/OFF the supply of a current to the first drive coil 40*a* is connected between the first drive coil 40*a* and the ground 42. A semiconductor switch is employed as the first drive coil control switch 43. The turning ON/OFF of the first drive coil control switch 43 is controlled by the first calculation portion 36.

The fourth electromagnetic relay 29*b* and the sixth electromagnetic relay 31*b* are opened/closed by a second drive coil

40*b*. The second drive coil 40*b* is connected to a power supply 44 and a ground 45. A second drive coil control switch 46 for turning ON/OFF the supply of a current to the second drive coil 40*b* is connected between the second drive coil 40*b* and the ground 45. A semiconductor switch is employed as the second drive coil control switch 46. The turning ON/OFF of the second drive coil control switch 46 is controlled by the second calculation portion 37.

A seventh electromagnetic relay 47*a* that is opened/closed in accordance with the opening/closing of the third electromagnetic relay 29*a*, and an eighth electromagnetic relay 48*a* that is opened/closed in accordance with the opening/closing of the fifth electromagnetic relay 31*a* are connected in series between a power supply 49 and a ground 50 via a resistor 51. The first calculation portion 36 detects a voltage of the resistor 51 on the power supply 49 side. Thus, the first calculation portion 36 monitors the open/closed states of the third electromagnetic relay 29*a* and the fifth electromagnetic relay 31*a*.

A ninth electromagnetic relay 47*b* that is opened/closed in accordance with the opening/closing of the fourth electromagnetic relay 29*b*, and a tenth electromagnetic relay 48*b* that is opened/closed in accordance with the opening/closing of the sixth electromagnetic relay 31*b* are connected in series between a power supply 52 and a ground 53 via a resistor 54. The second calculation portion 37 detects a voltage of the resistor 54 on the power supply 52 side. Thus, the second calculation portion 37 monitors the open/closed states of the fourth electromagnetic relay 29*b* and the sixth electromagnetic relay 31*b*.

The first calculation portion 36 and the second calculation portion 37 make a comparison between a command for the drive coil control switch 43 and the open/closed states of the electromagnetic relays 29*a* and 31*a* and a comparison between a command for the drive coil control switch 46 and the open/closed states of the electromagnetic relays 29*b* and 31*b*, respectively, thereby determining whether or not a malfunction such as the adhesion of a contact or the like has occurred in each of the electromagnetic relays 29*a*, 29*b*, 31*a*, and 31*b*.

The first calculation portion 36 compares a signal from the first current detector 25 with a signal from the second current detector 26 to determine whether or not a malfunction has occurred in the first current detector 25 and the second current detector 26. The first calculation portion 36 compares a signal from the first encoder 27 with a signal from the second encoder 28 to determine whether or not a malfunction has occurred in the first encoder 27 and the second encoder 28.

In addition, the first calculation portion 36 receives a calculation result obtained by the second calculation portion 37 via the two-port RAM 38, and compares the received calculation result with a calculation result obtained by the first calculation portion 36, thereby determining whether or not a malfunction has occurred in the first calculation portion 36 and the second calculation portion 37.

The second calculation portion 37 compares a signal from the first current detector 25 with a signal from the second current detector 26 to determine whether or not a malfunction has occurred in the first current detector 25 and the second current detector 26. The second calculation portion 37 compares a signal from the first encoder 27 with a signal from the second encoder 28 to determine whether or not a malfunction has occurred in the first encoder 27 and the second encoder 28.

In addition, the second calculation portion 37 receives a calculation result obtained by the first calculation portion 36 via the two-port RAM 38, and compares the received calculation result with a calculation result obtained by the second calculation portion 37, thereby determining whether or not a malfunction has occurred in the first calculation portion 36 and the second calculation portion 37.

When the above-mentioned malfunction occurs, each of the first calculation portion 36 and the second calculation portion 37 outputs a command to open corresponding ones of the electromagnetic relays 29*a*, 29*b*, 31*a*, and 31*b*, and outputs a malfunction detection signal to a malfunction reporting portion 55. When the malfunction detection signal is input to the malfunction reporting portion 55, the malfunction reporting portion 55 informs the elevator control device that some malfunction has occurred in the second brake control portion 14. When a malfunction occurs in the second brake control portion 14, the elevator control device stops the car 1 at, for example, the nearest floor, halts the traveling of the elevator apparatus, and causes the elevator apparatus to operate to report the occurrence of the malfunction to the outside.

The second brake control portion (deceleration control portion) 14 has the electromagnetic relays 29*a*, 29*b*, 31*a*, 31*b*, 47*a*, 47*b*, 48*a*, and 48*b*, the deceleration control switches 32 and 33, the discharge diode 35, the deceleration control determination portion 39, the drive coils 40*a* and 40*b*, the drive coil control switches 43 and 46, the resistors 51 and 54, and the malfunction reporting portion 55.

Figure 3:
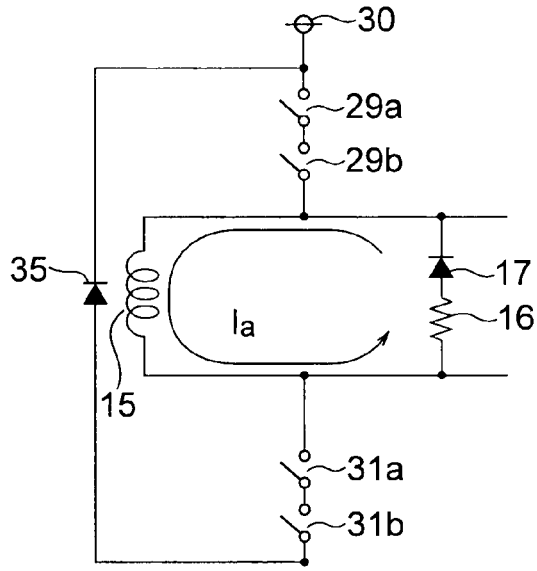
FIG. 3 is an explanatory diagram showing a current flowing through a brake coil of FIG. 2 at the time of braking.
Figure 4:
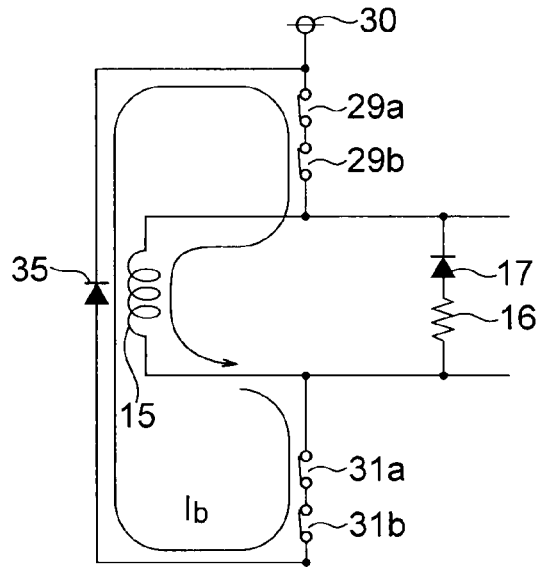
FIG. 4 is an explanatory diagram showing a state in the case where a third to a sixth electromagnetic relays of FIG. 3 are closed.
Figure 5:
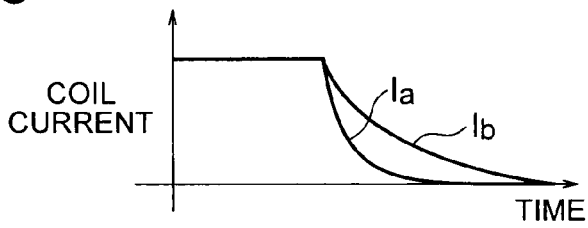
FIG. 5 is a graph showing how coil currents of FIGS. 3 and 4 change with time.

FIG. 3 is an explanatory diagram showing a current flowing through the brake coil 15 of FIG. 2 at the time of braking. FIG. 4 is an explanatory diagram showing a state in the case where the third electromagnetic relay 29*a* of FIG. 3, the fourth electromagnetic relay 29*b* of FIG. 3, the fifth electromagnetic relay 31*a* of FIG. 3, and the sixth electromagnetic relay 31*b* of FIG. 3 are closed. FIG. 5 is a graph showing how the coil currents of FIGS. 3 and 4 change with time.

As shown in FIG. 3, when the electromagnetic relays 29*a*, 29*b*, 31*a*, and 31*b* are open, a coil current Ia flows from the discharge resistor 16 into the first discharge diode 17. At this moment, the coil current Ia is converted into heat by the discharge resistor 16 and hence is deenergized immediately. On the other hand, as shown in FIG. 4, when the electromagnetic relays 29*a*, 29*b*, 31*a*, and 31*b* are closed, a coil current Ib hardly flows into the discharge resistor 16 but mainly flows through the third discharge diode 35. At this moment, the resistance of the third discharge diode 35 is small, and a large part of the current Ib is not converted into heat, so the current Ib is deenergized gradually.

When the current of the brake coil 15 is deenergized immediately, the braking force of the brake device 9 is generated in a short period of time. Conversely, when the current of the brake coil 15 is deenergized gradually, the braking force of the brake device 9 is increased gradually.

Thus, in the case where the car 1 decelerates from a moment when the supply of a current to the motor 6 is shut off to a moment when a braking force is applied immediately after the start of emergency stop operation (e.g., in the case where the weight on the car 1 side is lighter than the weight of the counterweight 2 while the car 1 is being operated to be lowered), each of the first calculation portion 36 and the second calculation portion 37 closes corresponding ones of the electromagnetic relays 29*a*, 29*b*, 31*a*, and 31*b* to apply the braking force gradually, with a view to preventing the degree of deceleration of the car 1 from becoming too high.

On the contrary, in the case where the car 1 accelerates immediately after the start of emergency stop operation (e.g., in the case where the weight on the car 1 side is heavier than the weight of the counterweight 2 while the car 1 is being operated to be lowered), each of the first calculation portion 36 and the second calculation portion 37 opens corresponding ones of the electromagnetic relays 29*a*, 29*b*, 31*a*, and 31*b* to apply the braking force immediately, with a view to decelerating the car 1 swiftly. Thus, the braking distance covered by the car 1 from the moment when emergency stop operation is started to the moment when the car 1 is stopped is shortened.

Figure 6:
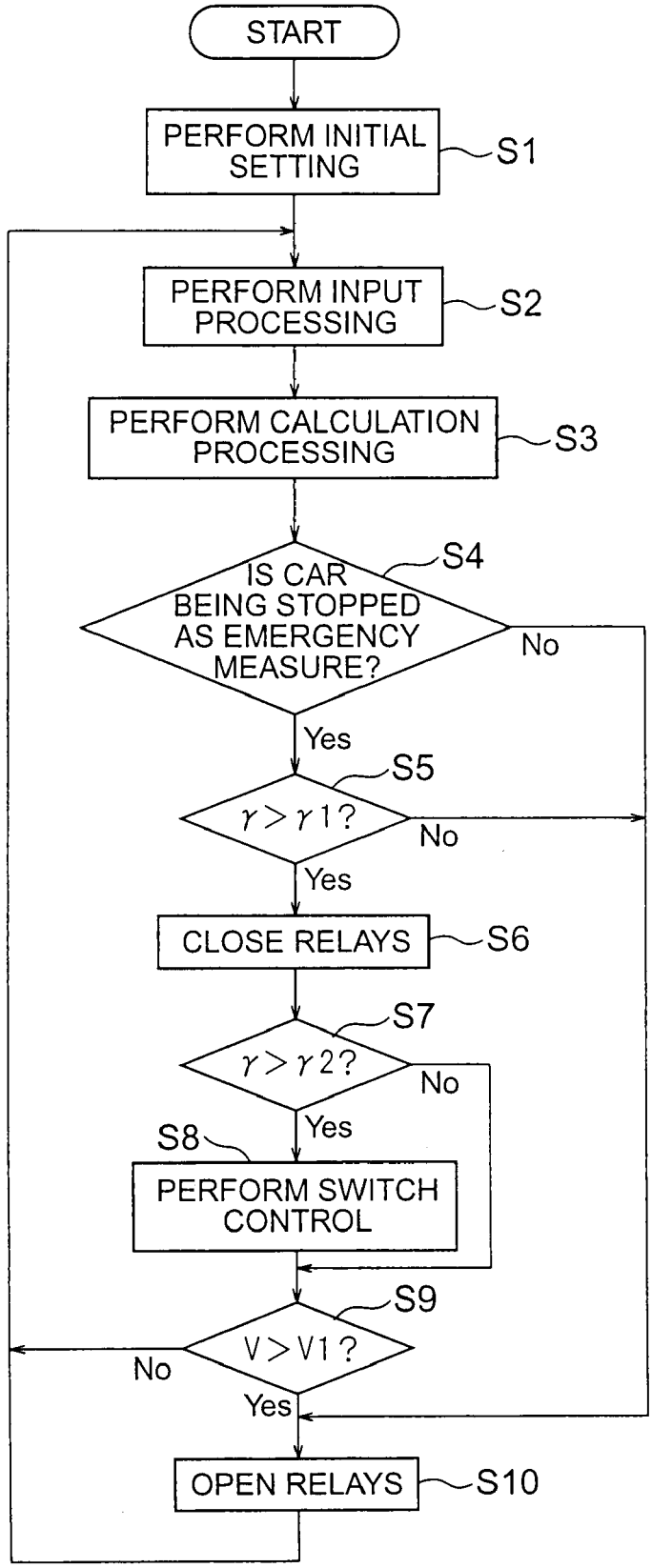
FIG. 6 is a flowchart showing deceleration control operation of each of a first and a second calculation portions of FIG. 2.

Reference will be made next to FIG. 6. FIG. 6 is a flowchart showing deceleration control operation of each of the first calculation portion 36 of FIG. 2 and the second calculation portion 37 of FIG. 2. The first calculation portion 36 and the second calculation portion 37 perform the processings shown in FIG. 6 at the same time and in tandem with each other. Referring to FIG. 6, the first calculation portion 36 and the second calculation portion 37 first perform initial settings of a plurality of parameters required for the processings (Step S1). In this example, a speed V0 [m/s] of the car 1 which is used to determine whether or not the car 1 is stopped, a speed V1 [m/s] of the car 1 at which deceleration control is stopped, a threshold I0 [A] of the current value of the brake coil 15, a first threshold γ1 [m/s$^2$] of the degree of deceleration of the car 1, and a second threshold γ2 [m/s$^2$] of the degree of deceleration of the car 1 (γ1<γ2) are set as the parameters.

The processings following the initial settings are performed repeatedly and periodically at intervals of a preset sampling period. That is, each of the first calculation portion 36 and the second calculation portion 37 acquires signals from the first encoder 27 and the second encoder 28 and signals from the first current detector 25 and the second current detector 26 at predetermined period (Step S2). Then, the first calculation portion 36 and the second calculation portion 37 calculate the position y [m] of the car 1, the speed V [m/s] of the car 1, and the deceleration γ [m/s$^2$] of the car 1 based on the signals from the first encoder 27 and the second encoder 28 (Step S3).

After that, the first calculation portion 36 and the second calculation portion 37 determine whether or not the car 1 is in emergency stop operation (Step S4). More specifically, when the speed of the car 1 (rotational speed of the motor) is higher than the speed V0 for determining whether or not the car 1 is stopped and the current value of the brake coil 15 is smaller than the current value I0 for determining whether or not the car 1 is stopped, the first calculation portion 36 and the second calculation portion 37 determine that the car 1 is in emergency stop operation. When the car 1 is not in emergency stop operation, the first calculation portion 36 and the second calculation portion 37 open all the electromagnetic relays 29*a*, 29*b*, 31*a*, and 31*b* (Step S10).

When the car 1 is in emergency stop operation, the first calculation portion 36 and the second calculation portion 37 determine whether or not the deceleration γ of the car 1 is higher than the first threshold γ1 (Step S5). When γ≦γ1, the first calculation portion 36 and the second calculation portion 37 open all the electromagnetic relays 29*a*, 29*b*, 31*a*, and 31*b* (Step S10). When γ>γ1, the first calculation portion 36 and the second calculation portion 37 close all the electromagnetic relays 29*a*, 29*b*, 31*a*, and 31*b* (Step S6).

In stopping the car 1 as an emergency measure, the supply of a current to the motor 6 is also shut off. Therefore, the car 1 may be accelerated or decelerated due to an imbalance between a load on the car 1 side and a load of the counterweight 2 from a moment when an emergency stop command is issued to a moment when a braking force is actually applied.

When γ≦γ1, the first calculation portion 36 and the second calculation portion 37 determine that the car 1 is accelerated immediately after the issuance of the emergency stop command, and open the electromagnetic relays 29*a*, 29*b*, 31*a*, and 31*b* to apply the braking force swiftly. When γ>γ1, the first calculation portion 36 and the second calculation portion 37 determine that the car 1 is decelerated, and close the electromagnetic relays 29*a*, 29*b*, 31*a*, and 31*b* to perform deceleration control, with a view to preventing the degree of deceleration of the car 1 from becoming excessively high.

During deceleration control, the first calculation portion 36 and the second calculation portion 37 determine whether or not the deceleration γ of the car 1 is higher than the second threshold γ2 (Step S7). When γ>γ2, the first calculation portion 36 and the second calculation portion 37 turn the deceleration control switches 32 and 33 ON/OFF with a preset switching duty (e.g., 50%) to suppress the deceleration γ of the car 1 (Step S8). Thus, a predetermined voltage is applied to the brake coil 15, so the braking force of the brake device 9 is controlled. At this moment, the deceleration control switches 32 and 33 are turned ON/OFF in synchronization with each other.

When γ≦γ2, the first calculation portion 36 and the second calculation portion 37 hold the deceleration control switches 32 and 33 open. After that, the first calculation portion 36 and the second calculation portion 37 determine whether to stop control or not (Step S9). In determining whether to stop control or not, the first calculation portion 36 and the second calculation portion 37 determine whether or not the speed V of the car 1 is equal to or lower than a threshold V1. When V≧V1, the first calculation portion 36 and the second calculation portion 37 directly return to an input processing (Step S2). When V<V1, the first calculation portion 36 and the second calculation portion 37 open all the electromagnetic relays 29*a*, 29*b*, 31*a*, and 31*b* (Step S10), and then return to the input processing (Step S2).

Figure 7:
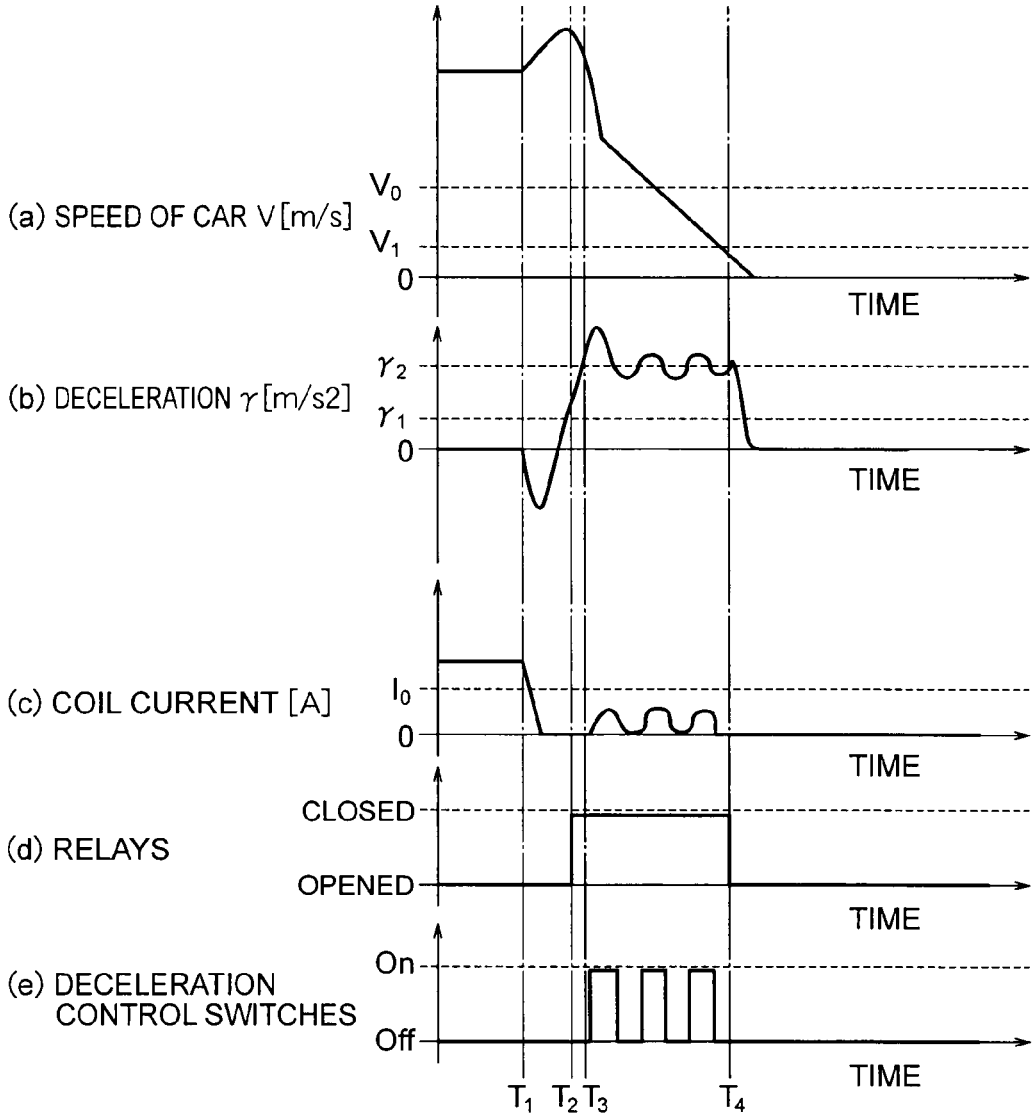
FIG. 7 is an explanatory diagram showing how the speed of a car, the degree of deceleration of the car, the current of the brake coil, the state of each of the electromagnetic relays, and the state of each of deceleration control switches change with time in a case where the car accelerates immediately after the issuance of an emergency stop command.

Reference will now be made to FIG. 7. FIG. 7 is an explanatory diagram showing how the speed of the car 1, the degree of deceleration of the car 1, the current of the brake coil 15, the states of the electromagnetic relays 29*a*, 29*b*, 31*a*, and 31*b*, and the states of the deceleration control switches 32 and 33 change with time in the case where the car 1 accelerates immediately after the issuance of an emergency stop command.

When the emergency stop command is issued, the car 1 is accelerated temporarily. After that, when a braking force is applied to the car 1, the car 1 is decelerated. Then, when the degree of deceleration of the car 1 reaches γ1 at a time instant T2, the electromagnetic relays 29*a*, 29*b*, 31*a*, and 31*b* are closed. When the degree of deceleration of the car 1 reaches γ2 at a time instant T3, the deceleration control switches 32 and 33 are turned ON/OFF. After that, when the speed of the car 1 becomes lower than V1, the electromagnetic relays 29*a*, 29*b*, 31*a*, and 31*b* are opened, so deceleration control performed by the deceleration control switches 32 and 33 is stopped.

Figure 8:
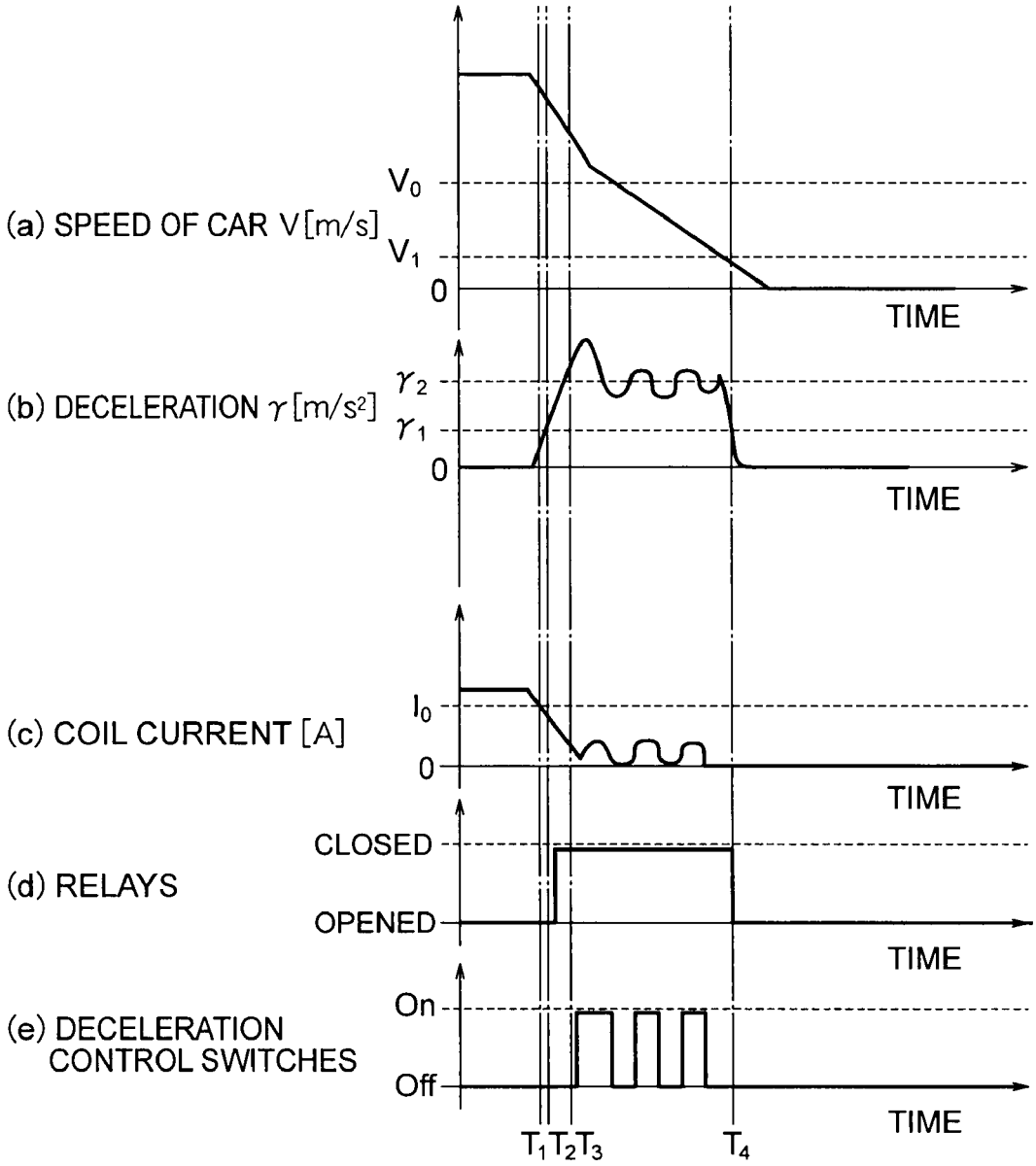
FIG. 8 is an explanatory diagram showing how the speed of the car, the degree of deceleration of the car, the current of the brake coil, the state of each of the electromagnetic relays, and the state of each of the deceleration control switches change with time in a case where the car decelerates immediately after the issuance of an emergency stop command.

FIG. 8 is an explanatory diagram showing how the speed of the car 1, the degree of deceleration of the car 1, the current of the brake coil 15, the states of the electromagnetic relays 29*a*, 29*b*, 31*a*, and 31*b*, and the states of the deceleration control switches 32 and 33 change with time in the case where the car 1 decelerates immediately after the issuance of an emergency stop command.

When the emergency stop command is issued, the car 1 starts decelerating immediately. Then, when the degree of deceleration of the car 1 reaches γ1 at the time instant T2, the electromagnetic relays 29*a*, 29*b*, 31*a*, and 31*b* are closed. When the degree of deceleration of the car 1 reaches γ2 at the time instant T3, the deceleration control switches 32 and 33 are turned ON/OFF. After that, when the speed of the car 1 becomes lower than V1, the electromagnetic relays 29*a*, 29*b*, 31*a*, and 31*b* are opened, so deceleration control performed by the deceleration control switches 32 and 33 is stopped.

Figure 9:
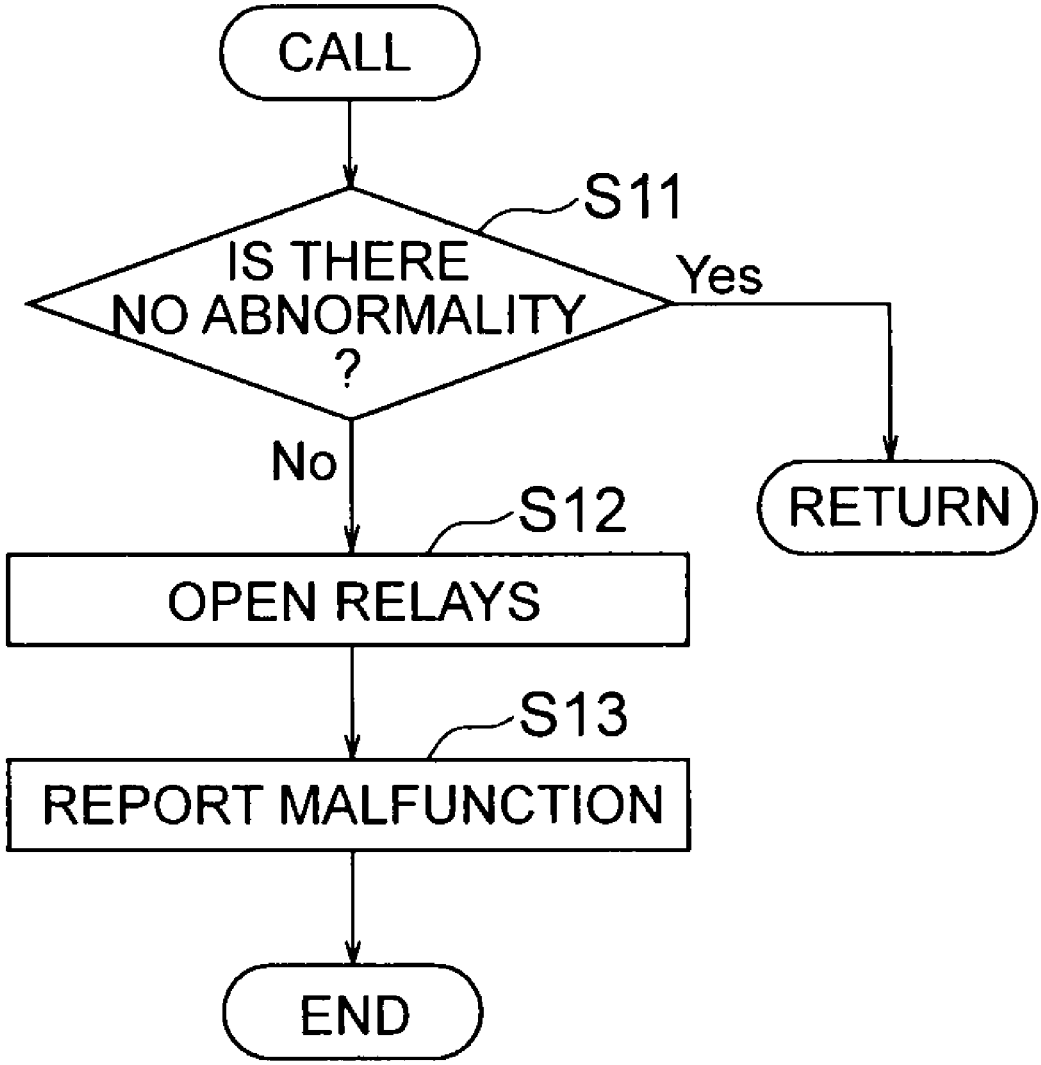
FIG. 9 is a flowchart showing abnormality diagnosis operation of each of the first and the second calculation portions of FIG. 2.

FIG. 9 is a flowchart showing abnormality diagnosis operation of each of the first calculation portion 36 and the second calculation portion 37 of FIG. 2. The first calculation portion 36 and the second calculation portion 37 call diagnosis processings shown in FIG. 9 as soon as the processings following the input processing (Step S2) of FIG. 6 are completed.

In abnormality diagnosis operation, the first calculation portion 36 and the second calculation portion 37 make a determination on the consistency of values input from the sensors and values calculated by the calculation portions 36 and 37 (Step S11). More specifically, when the difference between the input values and the difference between the calculated values are within each of predetermined ranges, the first calculation portion 36 and the second calculation portion 37 determine that there is no abnormality, and return to the subsequent processing shown in FIG. 6. When the difference between the input values or the difference between the calculated values exceeds a corresponding one of the predetermined ranges, the first calculation portion 36 and the second calculation portion 37 determine that there is an abnormality, open the electromagnetic relays 29*a*, 29*b*, 31*a*, and 31*b* (Step S12), and output malfunction detection signals to the malfunction reporting portion 55 (Step S13).

In the elevator apparatus configured as described above, the brake control device 11 has the first brake control portion 13 and the second brake control portion 14, and the second brake control portion 14 detects emergency braking operation of the brake device 9 independently of the first brake control portion 13. Therefore, while the degree of deceleration of the car 1 at the time of emergency braking can be suppressed, the car 1 can be stopped more reliably even in the event of a malfunction in the second brake control portion 14 serving as the deceleration control portion.

The second brake control portion 14 monitors the speed of the car 1 and the current of the brake coil 15 to detect that the brake device 9 has started emergency braking operation. Therefore, emergency braking operation of the brake device 9 can be detected with ease.

In addition, when the speed of the car 1 is higher than the predetermined speed V0 and the current of the brake coil 15 is smaller than the predetermined value I0, the second brake control portion 14 determines that the brake device 9 is in emergency stop operation. Therefore, emergency braking operation can be detected more reliably.

Still further, the second brake control portion 14 compares the signals from the first encoder 27 and the second encoder 28 with each other to detect a malfunction in at least one of the encoders 27 and 28, and compares the signals from the first current detector 25 and the second current detector 26 with each other to detect a malfunction in at least one of the current detectors 25 and 26. Therefore, enhancement of reliability can be achieved.

When a malfunction in at least either at least one of the encoders 27 and 28 or at least one of the current detectors 25 and 26 is detected, the second brake control portion 14 invalidates deceleration control performed thereby, so the car 1 can be stopped more reliably even in the event of a malfunction in at least one of the sensors.

Further, the second brake control portion 14 has the first calculation portion 36 and the second calculation portion 37 that perform both the operation of determining whether or not the brake device 9 has started emergency braking operation and the operation of reducing the braking force of the brake device 9 independently of each other through the calculation processings. Therefore, enhancement of reliability can be achieved.

Still further, the first calculation portion 36 and the second calculation portion 37 compare calculation results thereof with each other to detect the occurrence of a malfunction in at least one of the first calculation portion 36 and the second calculation portion 37. Therefore, further enhancement of reliability can be achieved.

When a malfunction occurs in at least one of the first calculation portion 36 and the second calculation portion 37, the second brake control portion 14 invalidates deceleration control performed thereby. Therefore, the car 1 can be stopped more reliably even in the event of a malfunction in at least one of the calculation portions 36 and 37.

Further, the second brake control portion 14 can detect an abnormality in the operation of opening/closing the electromagnetic relays 29*a*, 29*b*, 31*a*, and 31*b*. Therefore, enhancement of reliability can be achieved.

Still further, the second brake control portion 14 has the discharge diode 35 that is connected in parallel to the brake coil 15 by closing all the electromagnetic relays 29*a*, 29*b*, 31*a*, and 31*b*. Therefore, a back electromotive force generated as a result of an inductance of the brake coil 15 can be suppressed when the deceleration control switches 32 and 33 are repeatedly turned ON/OFF.

When the car 1 decelerates immediately after the start of emergency braking operation of the brake device 9, the second brake control portion 14 validates the control of the degree of deceleration of the car 1 immediately, so the degree of deceleration of the car 1 can be prevented more reliably from becoming excessively high. In addition, when the car 1 accelerates, the second brake control portion 14 validates the control of the degree of deceleration of the car 1 after the car 1 starts decelerating. Therefore, a braking force can be applied to the car 1 swiftly, and the braking distance of the car 1 can be prevented from becoming long.

In the foregoing example, the encoders 27 and 28 provided on the motor 6 are exemplified as the speed sensors. However, the speed sensors may be provided at another location, for example, on a speed governor, as long as each of the speed sensors can generate a signal corresponding to a speed of the car 1.

In the foregoing example, the determination on emergency stop is made from the speed of the car 1 and the current value of the brake coil 15. However, the determination on emergency stop may be made in consideration of a derivative value of the current value of the brake coil 15 as well as the aforementioned values. More specifically, when the speed of the car 1 is higher than a predetermined speed, the current of the brake coil 15 is smaller than a predetermined value, and the derivative value of the current value of the brake coil 15 is negative, it is determined that the car 1 is being stopped as an emergency measure. Thus, the occurrence of erroneous detection resulting from vibrations within the car 1 in the process of stopping the car 1 can be avoided.

Further, although no concrete thresholds are exemplified in the foregoing example, the average emergency stop degree of deceleration of the car 1 is about 3.0 [m/s$^2$] when, for example, V0=0.5 [m/s], V1=0.1 [m/s], $\gamma$1=2.0 [m/s$^2$], $\gamma$2=3.0 [m/s$^2$], and I0=1 [A]. Therefore, the burden imposed on passengers within the car 1 is light, and the braking distance of the car 1 does not become long.

Still further, only the single brake device 9 is illustrated in the foregoing example. However, a plurality of brake devices 9 connected in parallel may be employed. Thus, even when one of the brake devices breaks down, the other brake devices are in operation. Therefore, the reliability of the entire elevator apparatus can be enhanced.

In the foregoing example, the brake device 9 is provided on the hoisting machine 4. However, the brake device 9 may be provided at another location. For example, the brake device may be a car brake mounted on the car, or a rope brake for gripping the main rope to brake the car.

The invention claimed is:

1. An elevator apparatus, comprising:

a hoisting machine having a drive sheave, a motor for rotating the drive sheave, and a brake device for braking rotation of the drive sheave;

suspension means looped around the drive sheave;

a car suspended by the suspension means to be raised/lowered by the hoisting machine; and a brake control device for controlling the brake device, wherein:

the brake control device has a first brake control portion for operating the brake device upon detection of an abnormality to stop the car as an emergency measure, and a second brake control portion for reducing a braking force of the brake device when a degree of deceleration of the car becomes equal to or higher than a predetermined value at a time of emergency braking operation of the first brake control portion; and the second brake control portion detects emergency braking operation of the brake device independently of the first brake control portion.

2. The elevator apparatus according to claim 1, wherein:

the brake device has a brake coil, energizes the brake coil to generate an electromagnetic force for canceling a braking force, and shuts off supply of a current to the brake coil to generate a braking force; and the second brake control portion monitors a speed of the car and a current of the brake coil to detect emergency braking operation of the brake device.

3. The elevator apparatus according to claim 2, wherein the second brake control portion determines that the brake device performs emergency stop operation, when the speed of the car is higher than a predetermined speed and the current of the brake coil is smaller than a predetermined value.

4. The elevator apparatus according to claim 3, further comprising:

a plurality of speed sensors for detecting a speed of the car; and a plurality of current detectors for detecting a current of the brake coil, wherein the second brake control portion compares signals from the speed sensors with each other to detect a malfunction in at least one of the speed sensors, and compares signals from the current detectors with each other to detect a malfunction in at least one of the current detectors.

5. The elevator apparatus according to claim 4, wherein the second brake control portion invalidates control of a degree of deceleration of the car performed by the second brake control portion when a malfunction is detected in at least either at least one of the speed sensors or at least one of the current detectors.

6. The elevator apparatus according to claim 1, wherein the second brake control portion has a first calculation portion and a second calculation portion that perform both an operation of determining whether or not emergency braking operation of the brake device is started and an operation of reducing a braking force of the brake device independently of each other through calculation processings.

7. The elevator apparatus according to claim 6, wherein the first calculation portion and the second calculation portion compare calculation results thereof with each other to detect occurrence of a malfunction in at least one of the first calculation portion and the second calculation portion.

8. The elevator apparatus according to claim 7, wherein the second brake control portion invalidates control of a degree of deceleration of the car performed by the second brake control portion when a malfunction occurs in at least one of the first calculation portion and the second calculation portion.

9. The elevator apparatus according to claim 6, wherein the second brake control portion has a first deceleration control switch connected in series to the brake coil to be opened/closed in accordance with a calculation result of the first calculation portion, and a second deceleration control switch connected in series to the brake coil and the first deceleration control switch to be opened/closed in accordance with a calculation result of the second calculation portion.

10. The elevator apparatus according to claim 9, wherein the first deceleration control switch and the second deceleration control switch are opened/closed in synchronization with each other.

11. The elevator apparatus according to claim 2, wherein the second brake control portion has a plurality of relays connected between the brake coil and a power supply and between the brake coil and a ground, respectively, and opens/closes the relays to allow a changeover between validation and invalidation of control of the degree of deceleration of the car.

12. The elevator apparatus according to claim 11, wherein the second brake control portion can detect an abnormality in an operation of opening/closing the relays.

13. The elevator apparatus according to claim 11, wherein the second brake control portion further has a diode that is connected in parallel to the brake coil by closing all the relays.

14. The elevator apparatus according to claim 1, wherein the second brake control portion validates control of the degree of deceleration of the car immediately in a case where the car decelerates immediately after start of emergency braking operation of the brake device, and validates control of the degree of deceleration of the car after the car starts decelerating in a case where the car accelerates immediately after start of emergency braking operation of the brake device.

* * * * *